US006379118B2

(12) United States Patent
Lutum et al.

(10) Patent No.: US 6,379,118 B2
(45) Date of Patent: Apr. 30, 2002

(54) COOLED BLADE FOR A GAS TURBINE

(75) Inventors: Ewald Lutum, Brugg (CH); Klaus Semmler, Dachau (DE); Jens Wolfersdorf, Untersiggenthal (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/758,188

(22) Filed: Jan. 12, 2001

(30) Foreign Application Priority Data

Jan. 13, 2000 (DE) ..... 100 01 109

(51) Int. Cl.[7] ..... F01D 5/18
(52) U.S. Cl. ..... 416/97 R
(58) Field of Search ..... 416/97 R; 415/115

(56) References Cited

U.S. PATENT DOCUMENTS

| | | | | |
|---|---|---|---|---|
| 4,384,823 A | | 5/1983 | Graham et al. | |
| 4,669,957 A | | 6/1987 | Phillips et al. | |
| 4,770,608 A | | 9/1988 | Anderson et al. | |
| 5,370,499 A | | 12/1994 | Lee | |
| 5,383,766 A | | 1/1995 | Przirembel et al. | |
| 5,419,039 A | | 5/1995 | Auxier et al. | |
| 5,419,681 A | * | 5/1995 | Lee | 416/97 R |
| 5,562,409 A | | 10/1996 | Livsey et al. | |
| 5,651,662 A | * | 7/1997 | Lee et al. | 416/97 R |
| 5,667,359 A | * | 9/1997 | Huber et al. | 416/97 R X |
| 5,702,232 A | * | 12/1997 | Moore | 416/97 R X |
| 5,720,431 A | | 2/1998 | Sellers et al. | |
| 5,752,801 A | * | 5/1998 | Kennedy | 415/115 |
| 5,931,638 A | * | 8/1999 | Krause et al. | 416/97 R |
| 6,247,896 B1 | * | 6/2001 | Auxier et al. | 416/97 R |
| 6,254,334 B1 | * | 7/2001 | LaFleur | 415/115 |

FOREIGN PATENT DOCUMENTS

| | | |
|---|---|---|
| DE | 2 061 729 | 6/1971 |
| EP | 0 742 347 A2 | 11/1996 |
| WO | 99/06672 | 2/1999 |

* cited by examiner

*Primary Examiner*—John E. Ryznic
(74) *Attorney, Agent, or Firm*—Burns, Doane, Swecker & Mathis, L.L.P.

(57) ABSTRACT

In a cooled blade for a gas turbine, a cooling fluid, preferably cooling air, flows for convective cooling through internal cooling passages located close to the wall and is subsequently deflected for external film cooling through film-cooling holes onto the blade surface. The fluid flow is directed in at least some of the internal cooling passages in counterflow to the hot-gas flow flowing around the blade. Homogeneous cooling in the radial direction is achieved by providing a plurality of internal cooling passages and film-cooling holes arranged one above the other in the radial direction in the blade in such a way that the discharge openings of the film-cooling holes in each case lie so as to be offset from the internal cooling passages, and in particular the discharge openings lie between the internal cooling passages.

16 Claims, 9 Drawing Sheets

COOLED BLADE FOR A GAS TURBINE

This application claims priority under 35 U.S.C. §§ 119 and/or 365 to Appln. Ser. No. 100 01 109.8 filed in Germany on Jan. 13, 2000; the entire content of which is hereby incorporated by reference.

The present invention relates to the field of gas turbine technology. It concerns a cooled blade for a gas turbine, where the blade has internal cooling passages located close to the wall of the blade. Cooling fluid such as air flows for convective cooling through the internal cooling passages and is subsequently deflected for external film cooling through film-cooling holes onto the blade surface.

BACKGROUND OF THE INVENTION

To increase the output and the efficiency, ever increasing turbine inlet temperatures are used in modem gas-turbine plants. In order to protect the turbine blades from the increased hot-gas temperatures, these blades have to be cooled more intensively than was necessary in the past. At high turbine inlet temperatures, both convective cooling and film-cooling elements are used. In order to increase the effectiveness of these types of cooling, it is desirable to reduce the wall-material thicknesses. Furthermore, optimum distribution between convective heat absorption of the cooling fluid and cooling-fluid temperature during the blow-out as a cooling film is desired.

Combinations of convective cooling and film cooling at reduced wall thicknesses have been disclosed, for example, in various publications including WO 99/06672, and patents U.S. Pat. No. 5,562,409, U.S. Pat. No. 4,770,608, and U.S. Pat. No. 5,720,431. In the disclosures, the convective cooling is carried out via impingement cooling, only a small part of the surface being cooled by the respective cooling-fluid jet, which is subsequently used for the film cooling. The convective cooling capacity of the fluid is therefore only partly utilized.

Patents U.S. Pat. No. 5,370,499 and U.S. Pat. No. 5,419,039 describe a method of avoiding this disadvantage. In this case, the cooling fluid is first used for convective cooling in passages close to the wall before it is blown out as a film. At the same time, the convective cooling passages may be provided with turbulence increasing devices (ribs, cylinders or crossed passages). However, the cooling fluid is always directed in these devices in parallel with the main-gas flow, which does not constitute the best solution for optimum cooling.

In the publication WO-Al-99/06672 mentioned above, it has been proposed to direct the cooling fluid in the convective part in an antiparallel manner i.e. in counterflow to the main-gas flow (and thus to the film-cooling flow). This results in cooling which is more homogeneous in the axial direction or in the direction of the hot-gas flow. However, it is still questionable whether homogeneous cooling or temperature distribution in the radial direction is achieved.

SUMMARY OF THE INVENTION

In one aspect of the invention, a cooled gas-turbine blade is provided, which also ensures a homogeneous distribution of the material temperature of the blade in the radial direction.

The turbine blade includes a plurality of internal cooling passages and film-cooling holes arranged one above the other in the radial direction of the blade, with the discharge openings of the film-cooling holes being offset from the internal cooling passages, and in particular, the discharge openings of the film-cooling holes lie between the internal cooling passages.

A plurality of internal cooling passages and film-cooling holes are arranged one above the other in the radial direction of the blade in such a way that the discharge openings of the film-cooling holes in each case lie so as to be offset from the internal cooling passages, and in particular lie between the internal cooling passages. Since the cooling effect of the film cooling between the holes is less than in the axial direction downstream of the holes, the cooling effect of the internal cooling is utilized in these intermediate regions by the arrangement according to the invention.

The cooling fluid is first directed in counterflow to the hot-gas flow in convective passages close to the wall, which are integrated in the overall structure and can be provided with turbulence-generating devices that affect the flow of the cooling fluid before the cooling fluid is used for film cooling. As a result, very uniform temperature distributions are produced, which is very important for the small wall thicknesses desired and the low wall thermal resistance associated therewith, since the temperature balance is impaired by heat conduction in the wall at small wall thicknesses. Furthermore, due to the deflection of the cooling fluid, which automatically occurs, an impulse can be applied, and this impulse is advantageous for the cooling effect of the cooling film, as has been described, for example, in Patent U.S. Pat. No. 4,384,823. A swirl can also be produced in the "prechamber" of the film-cooling hole, as described in Patent U.S. Pat. No. 4,669,957.

A first preferred embodiment of the blade according to the invention is distinguished by the fact that turbulence-generating elements are arranged in the internal cooling passages. In this way, the contact between cooling fluid and passage wall and thus the internal cooling can be further improved.

Specific amounts of cooling can be achieved if, as in a second preferred embodiment of the invention, cavities are arranged in the internal cooling passages for setting the cooling-fluid pressure or the cooling-fluid mass flow.

The internal cooling can also be improved if, as in another preferred embodiment, first ribs are arranged in the internal cooling passages for enlarging the heat-transfer area. First ribs can be designed so as to alternate in the flow direction as outer ribs and inner ribs, with the inner ribs having a larger height and/or width than the outer ribs.

A further increase in the cooling effect in the interior of the blade is achieved if, as in a further preferred embodiment of the invention, first impingement-cooling holes are provided in order to supply the internal cooling passages. The cooling fluid is passed through the impingement-cooling holes and enters the internal cooling passages in the form of impingement jets.

In addition to the internal cooling passages, a cooling passage may also be arranged in the blade nose. Cooling fluid is admitted into this cooling passage through second impingement-cooling holes. Second film-cooling holes are preferably directed from the cooling passage to the blade surface, the second impingement-cooling holes and the second film-cooling holes are arranged alternately, and second ribs are arranged between the second impingement-cooling holes and the second film-cooling holes for increasing the heat-transfer area and for separating the zones of the cooling passage which belong to the second impingement-cooling holes and the second film-cooling holes.

The internal cooling passages may run axially, and the film-cooling holes may in each case branch off from an associated internal cooling passage at an angle in the radial direction. However, it is also conceivable for the internal cooling passages to run axially, for the ends of the internal cooling passages to be connected by radial passages, and for the film-cooling holes to in each case be arranged between the internal cooling passages and start from the radial passages. Furthermore, it is conceivable in this connection for the internal cooling passages to run at an angle in the radial direction, and for the film-cooling holes to in each case branch off from an associated internal cooling passage in the axial direction. Alternatively, the internal cooling passages can run at a first angle in the radial direction, and the film-cooling holes can in each case branch off from an associated internal cooling passage at a second angle in the radial direction. In all cases, the film-discharge surfaces are arranged so as to be offset from the convective internal cooling passages, so that the internal cooling takes place precisely where the film cooling is less effective.

BRIEF DESCRIPTION OF THE DRAWINGS

The invention is explained in more detail below with reference to exemplary embodiments in connection with the drawings, in which.

DESCRIPTION OF THE PREFERRED EMBODIMENTS

Figure 1:
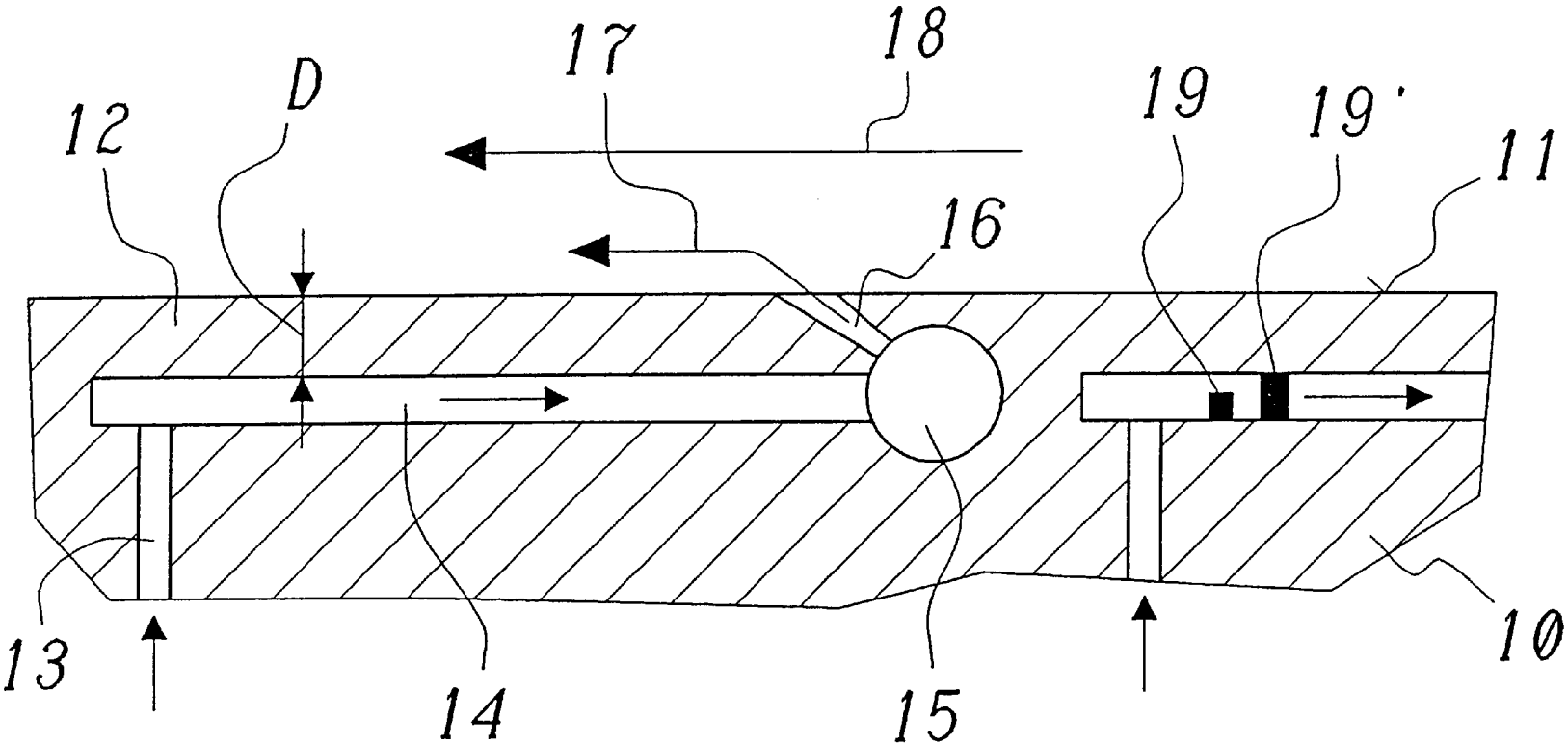
FIG. 1 shows, in a cross section of the marginal region of a blade according to the invention, a first preferred exemplary embodiment for an individual internal cooling passage with cooling fluid directed in counterflow to the hot-gas flow, and with additional turbulence-generating means provided in a portion of the internal cooling passage.

A first preferred embodiment of the invention, as shown in FIG. 1, includes an individual internal cooling passage having cooling fluid directed in counterflow to the hot-gas flow. Portions of the cooling passage are provided with and without additional turbulence-generating means, as shown in FIG. 1 in a cross section of the marginal region. The blade 10 is exposed along blade surface 11 to a hot-gas flow 18 (long arrow pointing from right to left). Internal cooling passages 14 are arranged below the blade surface 11, and are separated from the blade surface 11 only by a thin wall 12 of thickness D and run parallel to the blade surface 11. A cooling fluid, preferably cooling air—is fed at one end to the internal cooling passages 14, preferably via impingement-cooling holes 13. The cooling fluid then passes through the internal cooling passages 14 in counterflow to the (external) hot-gas flow 18. It is deflected in a deflection space 15 located at the other end of the internal cooling passages 14 and leaves the blade 10 as a film flow 17 through film-cooling holes 16, which start from the deflection space 15 in the direction of the hot-gas flow 18, in order to form a cooling film on the blade surface 11. In this case, the internal cooling passages 14 may have smooth walls; but may also be provided with turbulence-generating elements 19, 19', as can be seen on the right in FIG. 1.

This type of cooling is based on the idea of directing the cooling fluid first of all in counterflow to the hot-gas flow 18 in convective passages located close to the wall, which are integrated in the overall structure and can be provided with turbulence-generating devices, before the cooling fluid is used for the film cooling. As a result, very uniform temperature distributions are produced, which is very important for the small wall thicknesses D desired and the low wall thermal resistance associated therewith, since the temperature balance is impaired by heat conduction in the wall 12 at small wall thicknesses. Furthermore, due to the deflection of the cooling fluid, which automatically occurs, an impulse can be applied, and this impulse is advantageous for the cooling effect of the cooling film forming on the surface.

Figure 2:
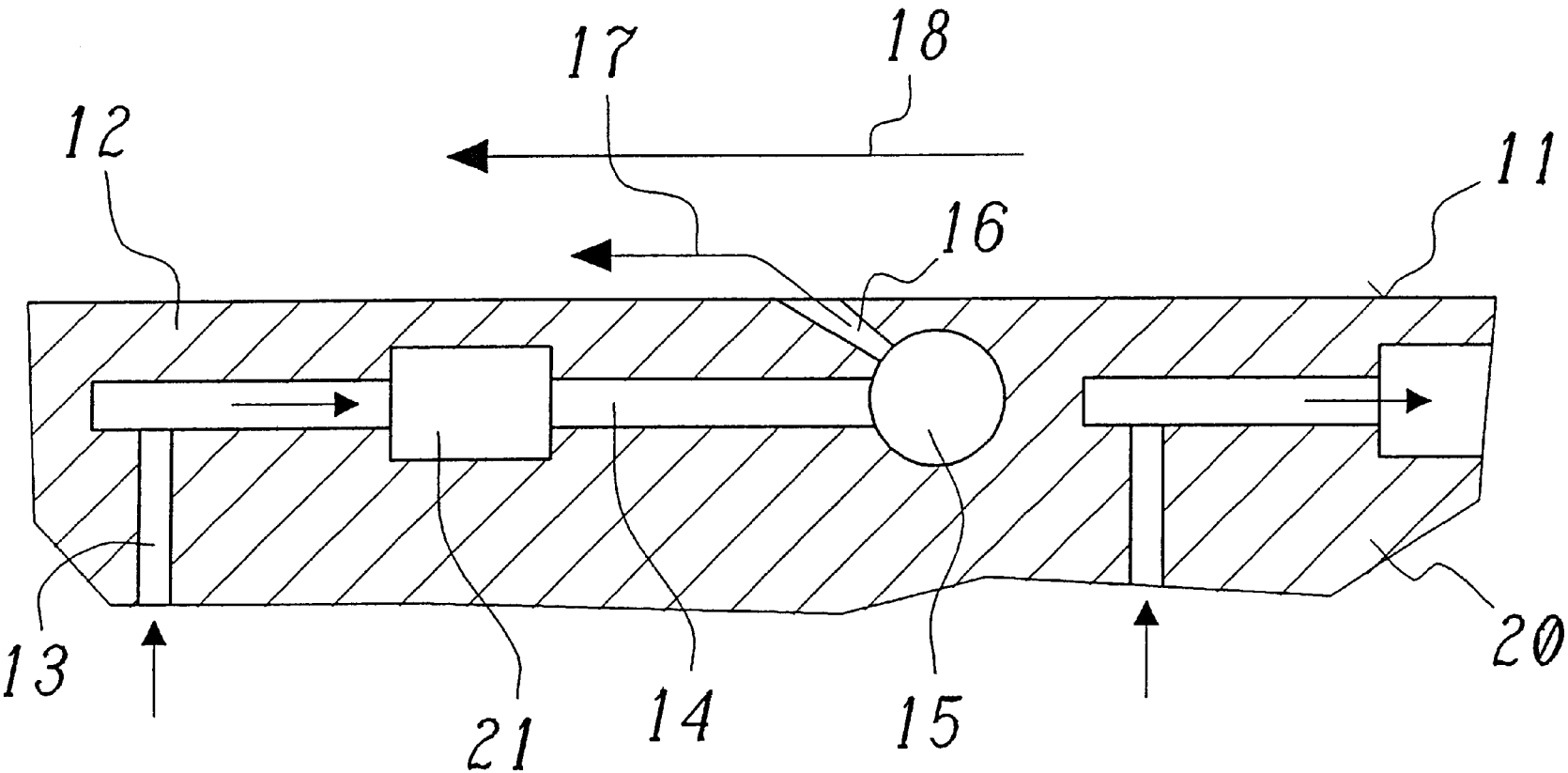
FIG. 2 shows an exemplary embodiment comparable with FIG. 1 having cavities in the internal cooling passages for setting the cooling-fluid mass flow.

Furthermore, as shown in FIG. 2, the connectively cooled internal cooling passages 14 may be provided with larger cavities 21, which enable the fluid pressure to be set in order to improve the film-cooling effectiveness and set the desired cooling-fluid mass flow.

Figure 3:
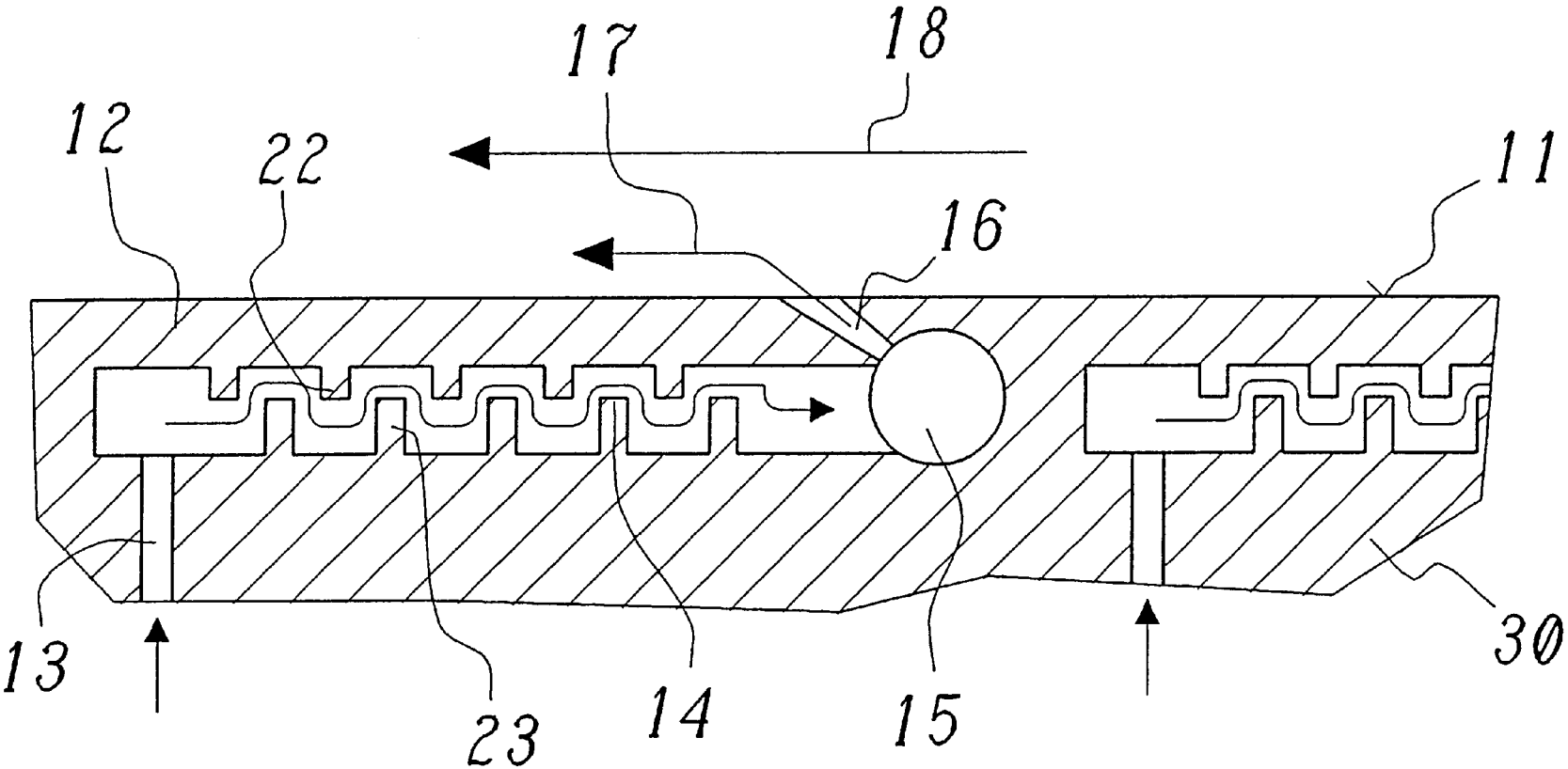
FIG. 3 shows an exemplary embodiment comparable with FIG. 1 having additional ribs in the internal cooling passage for enlarging the heat-transfer area.

FIG. 3 shows a further variant, by means of which the fluid pressure can be set and the surface necessary for the heat dissipation can be enlarged and the turbulence and thus the heat transfer can be increased. In this case, the integral convective internal cooling passages 14 are directed serpentine-like around inner and outer ribs 23 and 22 respectively. The internal cooling passage is again fed with cooling fluid by one (or more) impingement cooling hole(s) 13. The cooling fluid is then passed as a cooling film (through film cooling holes 16 which are angled in the flow direction and/or in the lateral direction and may be provided with diffuser extensions) in counterflow onto the outer blade surface 11. To account for the different temperature conditions, the inner ribs 23 should preferably be larger in height and/or width than the outer ribs 22.

Figure 4:
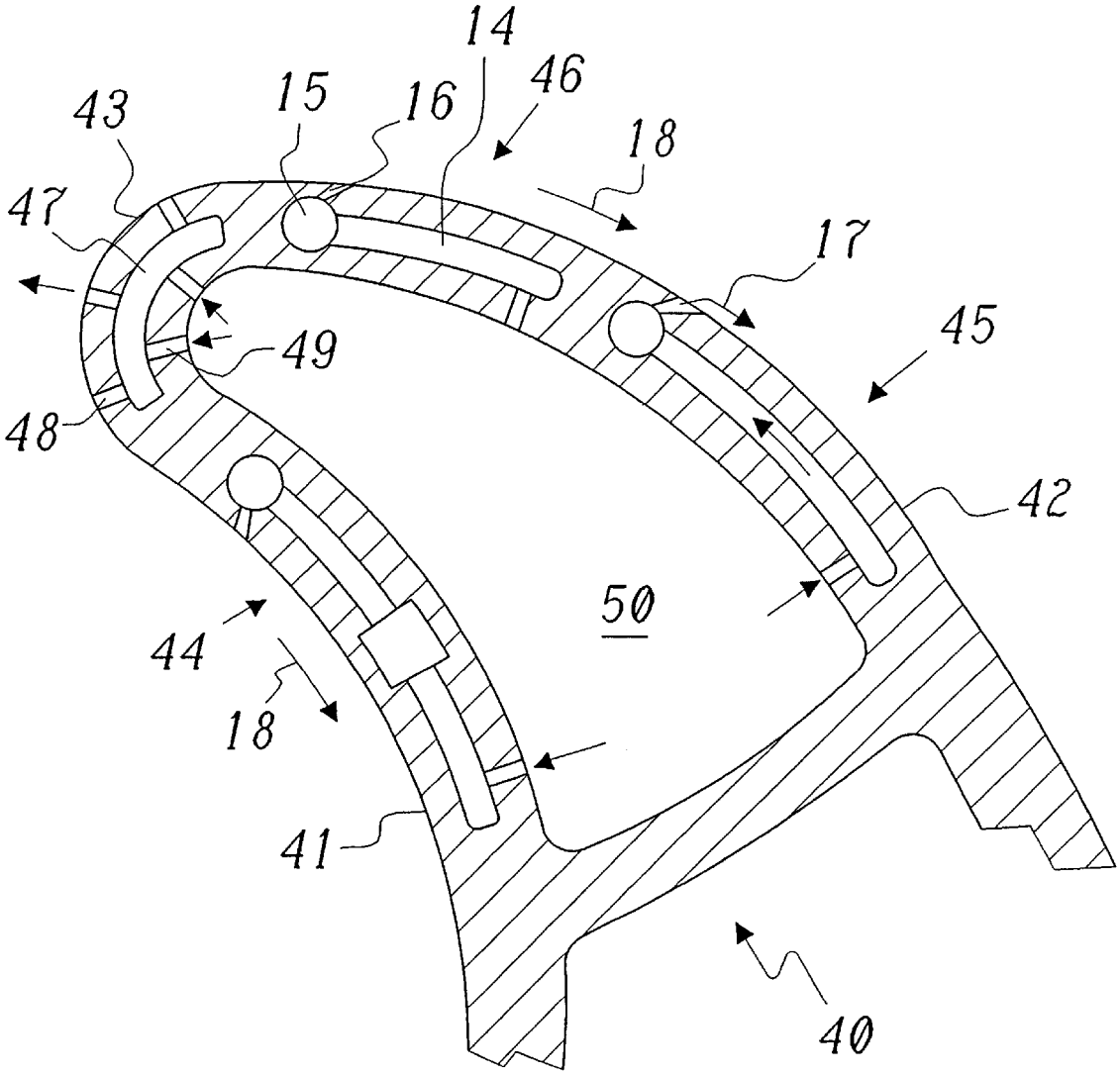
FIG. 4 shows, in a cross section, the leading-edge region of a cooled blade in another exemplary embodiment of the invention having an additional cooling passage in the blade nose.

Especially effective cooling can be achieved with the cooling geometry illustrated in FIG. 4 at the leading-edge region of a gas-turbine blade, in which case a combination with an impingement-cooled (and possibly film-cooled) blade nose 43, as described in Patent EP-Al-0 892 151, is possible. The walls of the blade 40 are provided with a plurality of the cooling arrangements 44–46 already described above, which in each case comprise internal bores 14 that are supplied with cooling fluid in counterflow on the inlet side from a (radial) main passage 50 via impingement-cooling holes 13. The cooling fluid is discharged as a cooling film on the outlet side via deflection spaces 15 and film-cooling holes 16 onto the blade surface (pressure surface 41 or suction surface 42). A cooling passage 47 is provided for cooling in the blade nose 43, and is supplied from the main passage 50 through impingement-cooling holes 49. The cooling film is delivered to the outside surface of the blade nose 43 via film cooling holes 48.

Figure 5:
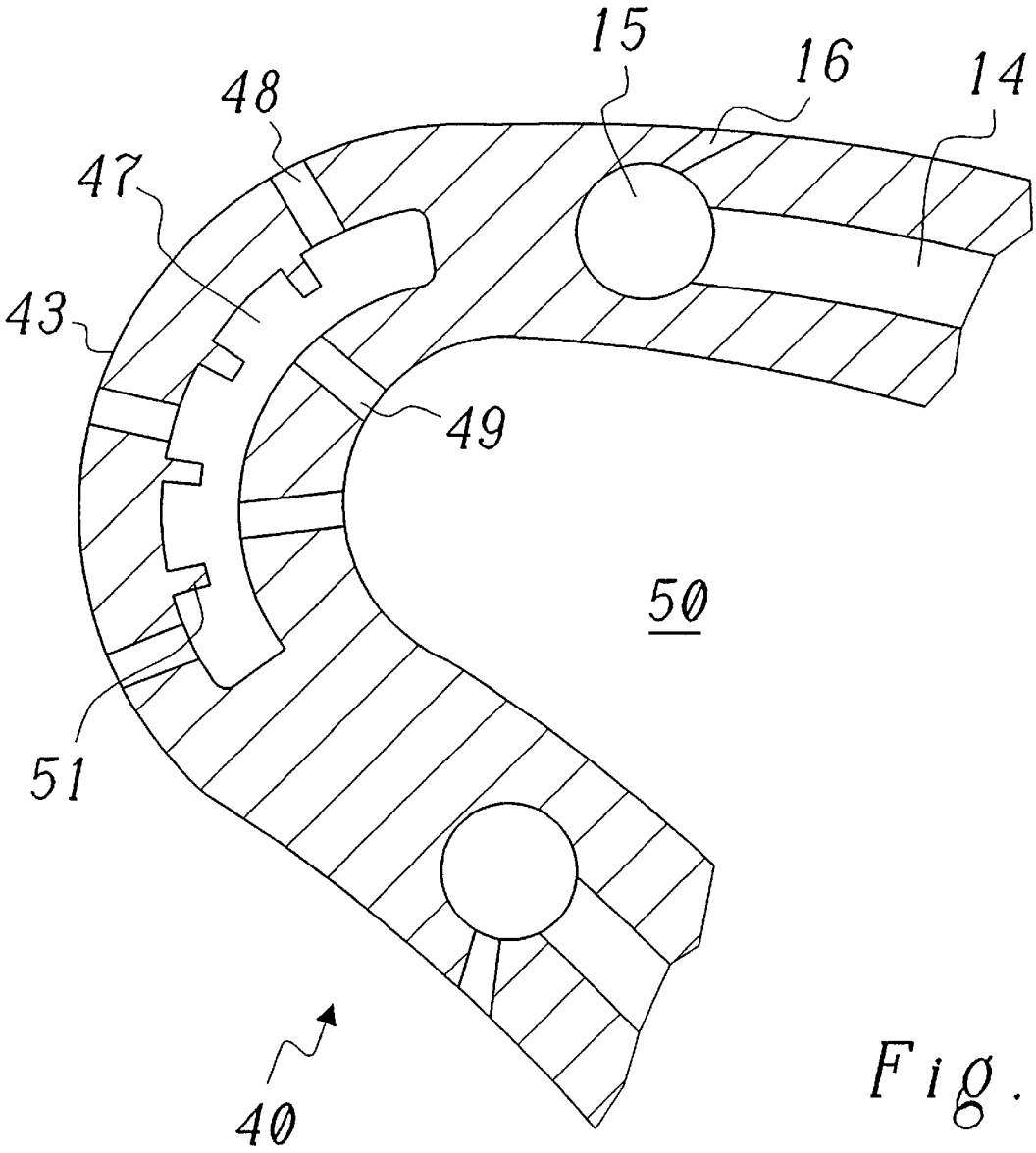
FIG. 5 shows, in an enlarged detail from FIG. 4, the blade nose with additional subdividing ribs in the cooling passage close to the edge.

As shown in FIG. 5, effective cooling may be further improved with the outer ribs 51 described above. These ribs 51, which may also be interrupted in the radial direction and then constitute rib segments (or pins), increase the heat-dissipating surface. Ribs 51 separate the surfaces that are struck by the impingement jets from the impingement-cooling holes 49 from the cavities from which the film-cooling holes 48 start. In this case, the film-cooling holes 48 may be arranged at an angle in the radial direction (perpendicular to the drawing plane of FIG. 5). This achieves the effect that the cooling fluid sweeps over the entire heat-dissipating surface available and high cooling effectiveness is achieved.

The arrangements specified permit a homogeneous material temperature distribution in the flow direction of the hot-gas flow 18, i.e. in the axial direction of the gas turbine. However, the invention also achieves a homogeneous distribution in the radial direction (perpendicular to the drawing plane in FIGS. 1 to 5) in order to increase the service life of a gas-turbine blade. This is ensured by the special arrangement according to the invention of internal cooling passages and film-cooling holes. The film-discharge surfaces (discharge openings of the film-cooling holes) are arranged so as to be offset from the convective internal cooling passages. Since the cooling effect of the film cooling between the holes is less than in the axial direction downstream of the holes, the cooling effect of the internal cooling can be utilized in these intermediate regions.

Figure 6:
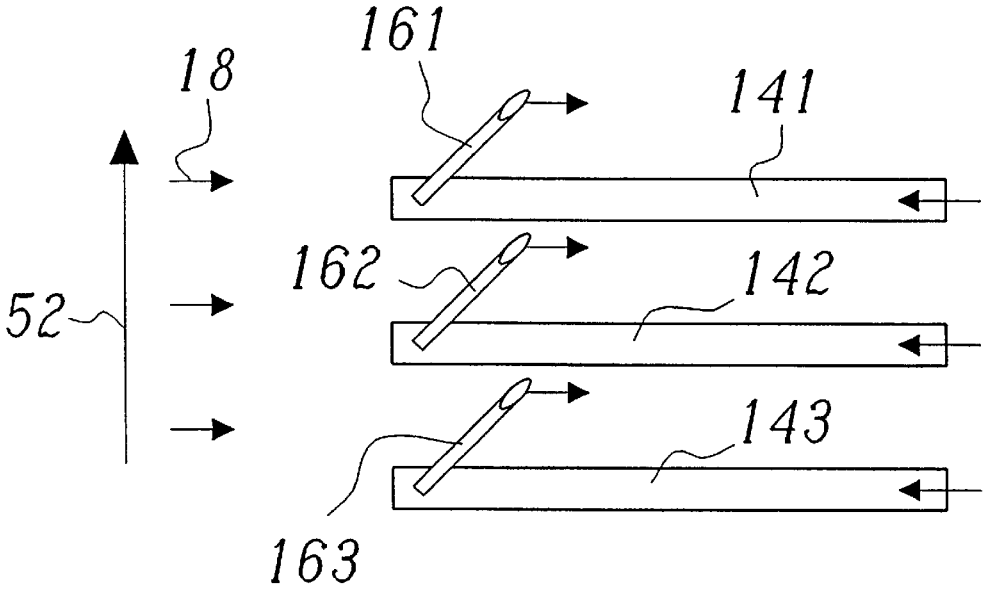

FIGS. 6–9 show possible basic arrangements which follow this idea. In FIG. 6, a plurality of internal cooling bores 141–143 are arranged in the radial direction 52 of the blade one above the other and parallel to one another at a uniform distance apart in the axial direction (parallel to the hot-gas flow 18). Film-cooling holes 161–163 are directed from the outlet-side ends of the internal-cooling passages 141–143 to the blade surface, which lies in the drawing plane. The film-cooling holes 161–163 are made at an angle in the radial direction, so that their (oval) film-discharge openings are in each case arranged between the internal cooling passages 141–143 lying in the wall.

Figure 7:
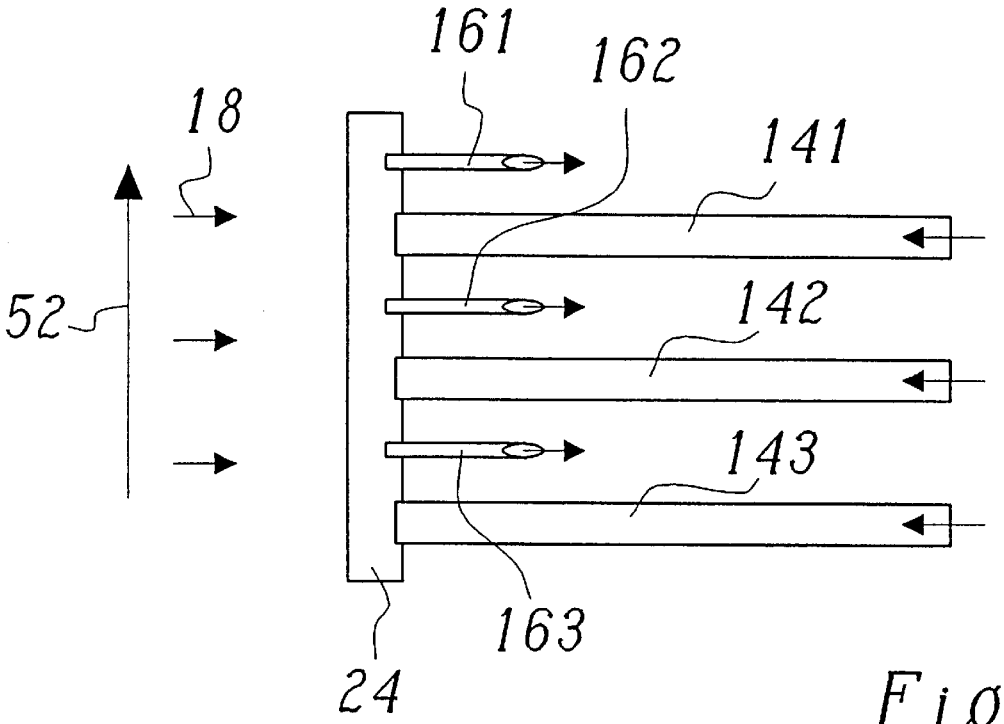
FIGS. 6–9 show various exemplary embodiments for the (offset) arrangement according to the invention of internal cooling passages and film-cooling holes in the radial direction of the blade according to the invention.

FIG. 7 illustrates an arrangement in which the ends of internal cooling passages 141–143 running axially in the wall are connected by radial passages 24. The film-cooling holes 161–163 are made between the internal cooling passages 141–143 so as to start from the radial passages 24 and run parallel to the internal cooling passages 141–143.

Figure 9:
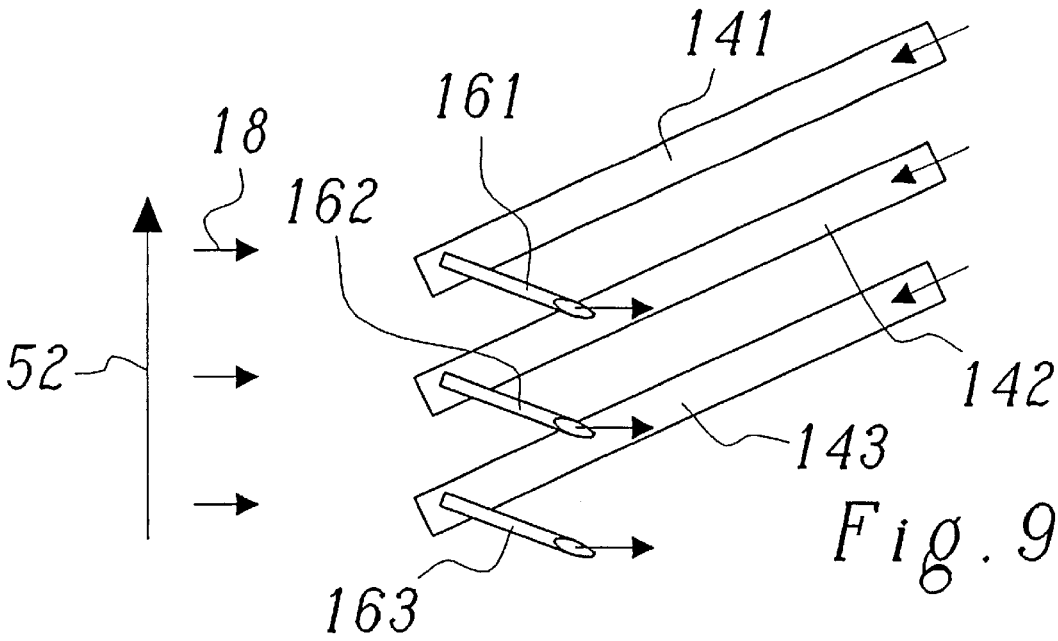
Figure 8:
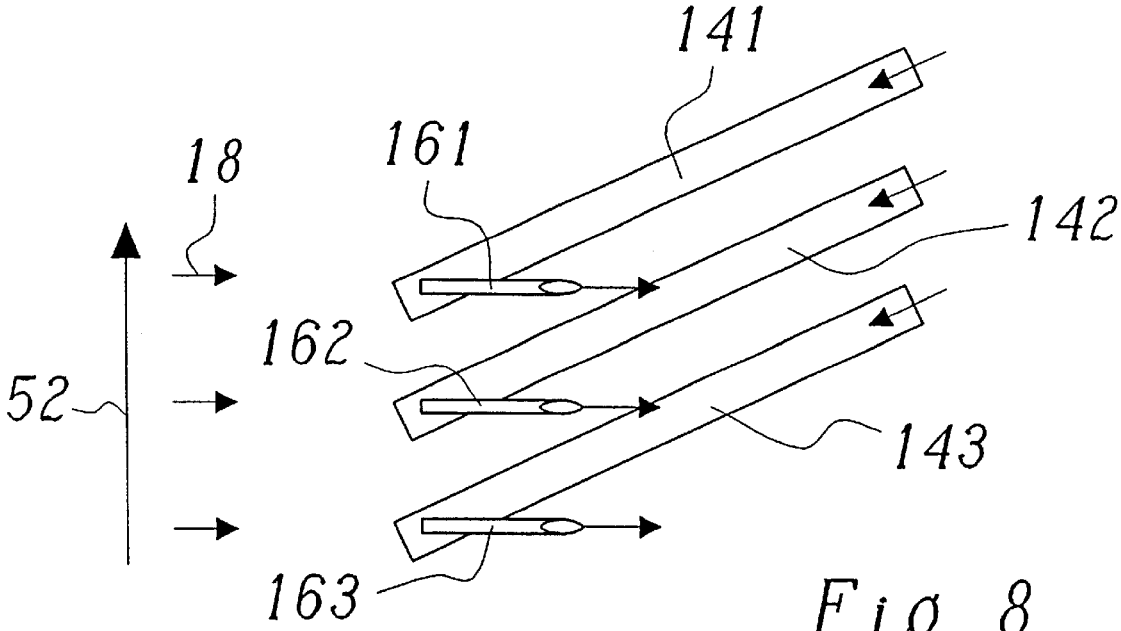
Figure 10:
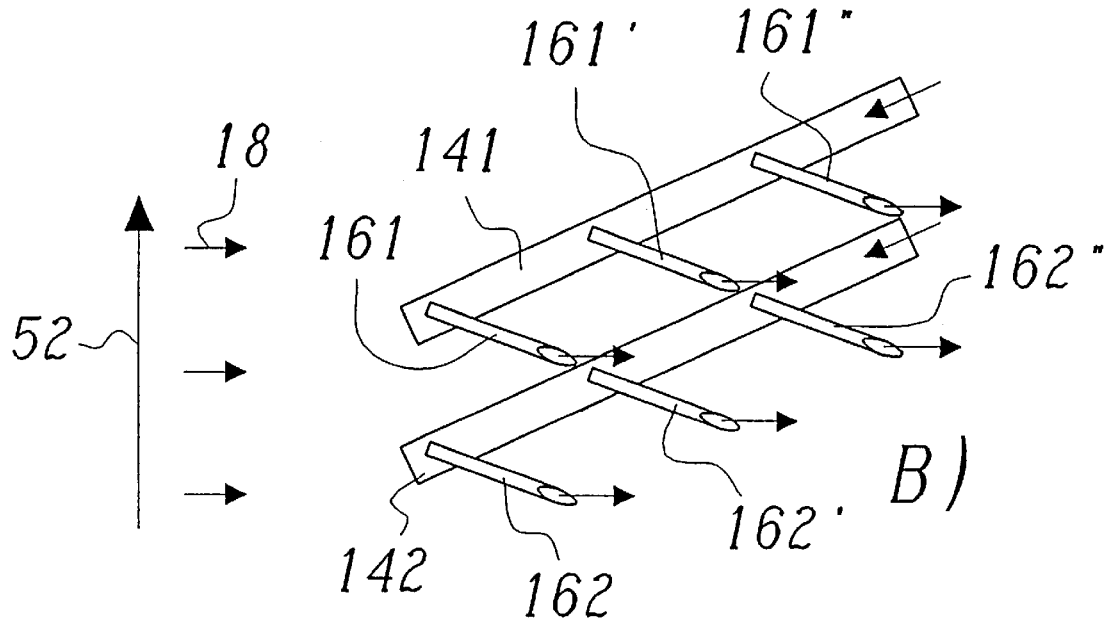
FIGS. 10A and 10B show two preferred exemplary embodiments for the arrangement of a plurality of film-cooling holes for each internal cooling passage in a blade according to the invention.
Figure 10:
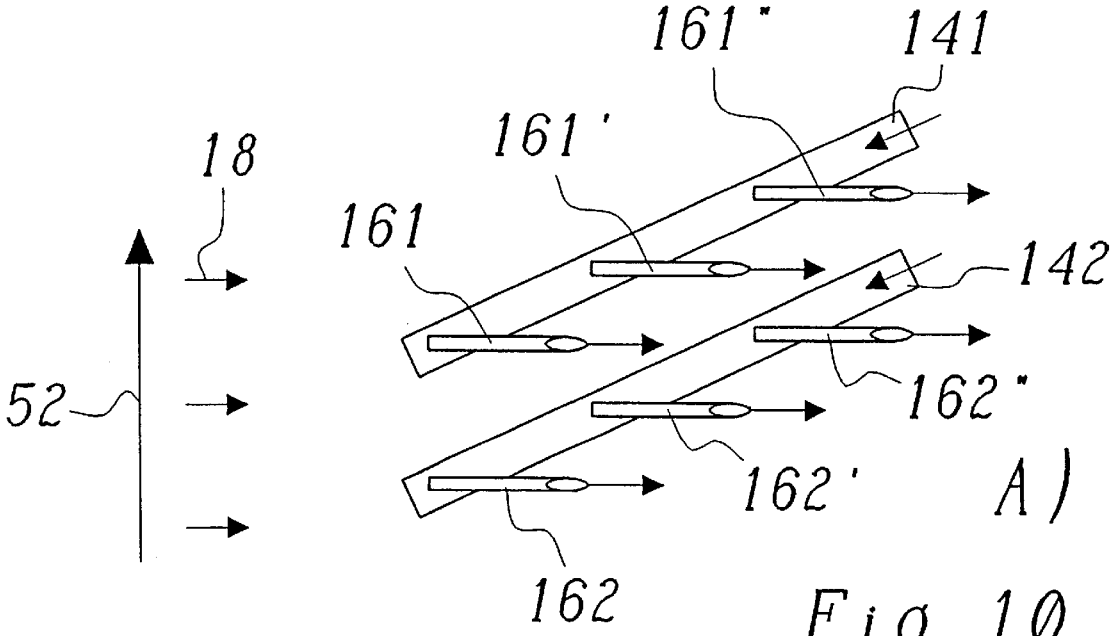

FIG. 8 shows a further arrangement. The internal cooling passages 141–143 are in this case made in the blade wall at an angle in the radial direction, whereas the film-cooling holes 161–163 branching off from them run axially. Combinations of these arrangements can be provided, as shown in FIG. 9 for example. In this case, both the internal cooling passages 141–143 and the film-cooling holes 161–163 are made at an associated angle in the radial direction. The matrix structure produced is especially effective for homogenization of the material temperature in the radial direction. In all cases, a plurality of film-cooling holes 161–161" and 162–162" for each internal cooling passage 141 and 142 respectively, can be provided as shown in FIG. 10A for angled passages and axial holes, and as shown in FIG. 10B for angled passages and angled holes. This is of course also possible for the other arrangements described.

Figure 12:
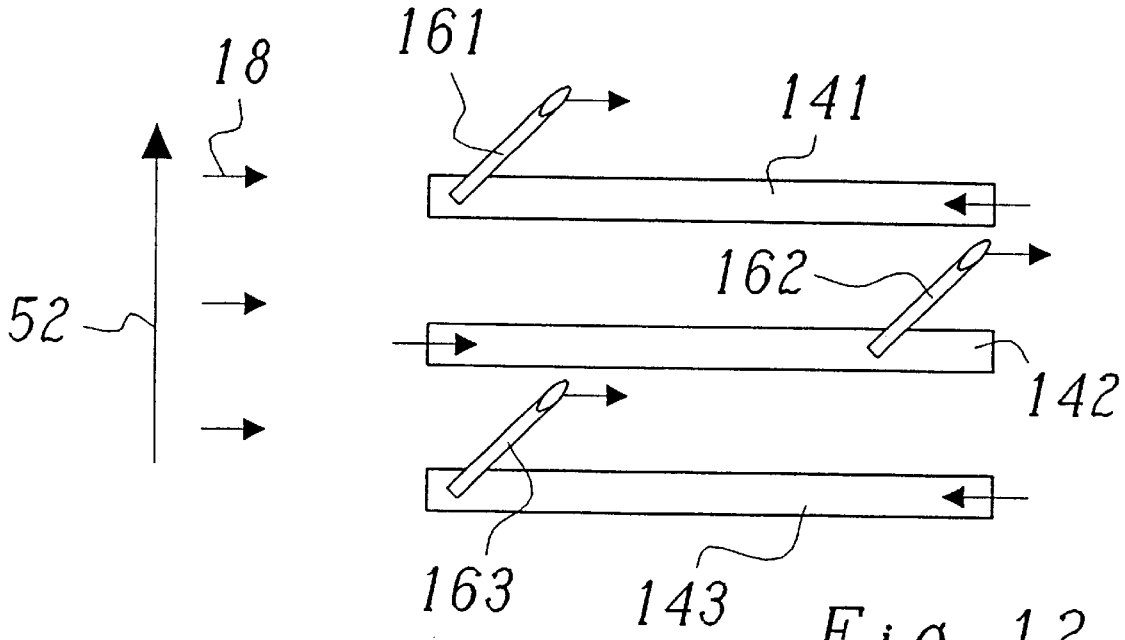
FIG. 12 shows another exemplary embodiment of the blade according to the invention having a deflection of the fluid flow by the positioning of the feeds (impingement-cooling holes) for the cooling fluid to the internal cooling passages.
Figure 11:
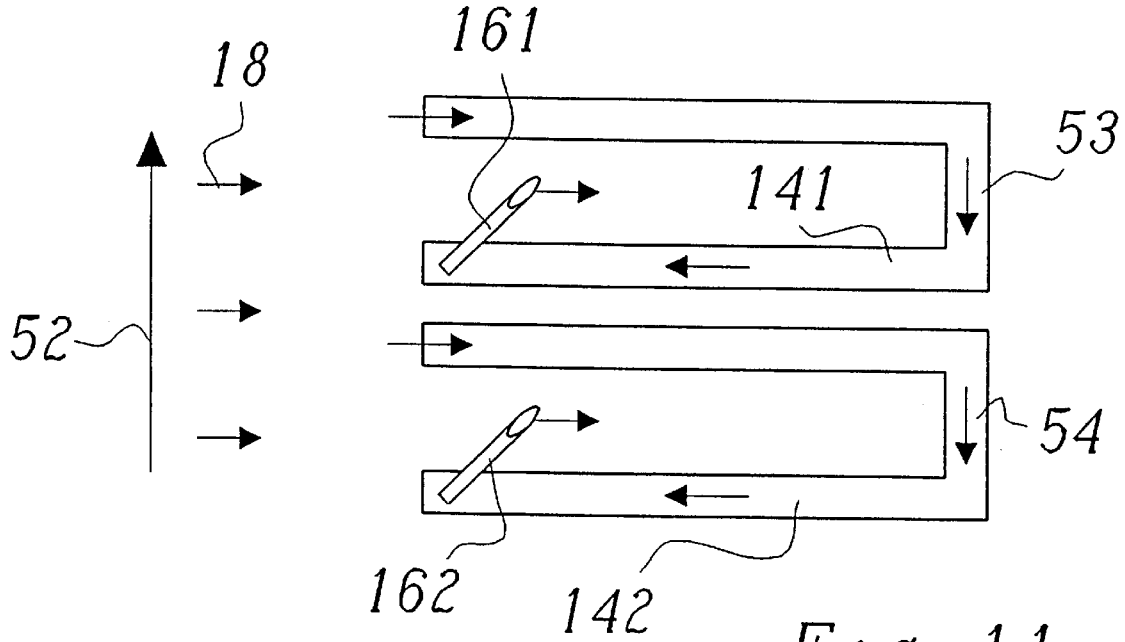
FIG. 11 shows an exemplary embodiment of the blade according to the invention having a deflection of the fluid flow into the counterflow by specific directing of the internal cooling passages.

The counterflow principle according to the invention for the homogenization of the wall temperature in the axial and radial directions may also be realized by the convective internal cooling passages 141–143 themselves, as indicated in FIGS. 11 and 12. In these cases, for the internal cooling air, the counterflow is achieved either by deflections 53, 54 (FIG. 11) or by feeding and discharging the cooling medium (e.g. via impingement-cooling holes and the film-cooling holes, as described above) at different axial positions (FIG. 12).

What is claimed is:

1. A cooled blade for a gas turbine, comprising:

a wall;

internal cooling passages located close to the wall and separated from a blade surface by the wall, at least some of said internal cooling passages being positioned for directing the flow of a cooling fluid, preferably cooling air for convective cooling, in counterflow to hot-gas flow flowing around the blade during operation of the gas turbine; and first film-cooling holes leading from said internal cooling passages to the blade surface, a plurality of said internal cooling passages and said first film-cooling holes being arranged one above the other in a radial direction of the blade with discharge openings of the first film-cooling holes being offset from the internal cooling passages and lying between the internal cooling passages.

2. The blade as claimed in claim 1, wherein turbulence-generating elements are arranged in the internal cooling passages.

3. The blade as claimed in claim 1, wherein cavities are defined in the internal cooling passages for setting the cooling-fluid pressure or the cooling-fluid mass flow.

4. The blade as claimed in claim 1, wherein first ribs are arranged in the internal cooling passages for enlarging a heat-transfer area.

5. The blade as claimed in claim 4, wherein the first ribs are arranged within the internal cooling passages to alternate in the flow direction as outer ribs and inner ribs, and the inner ribs have at least one of a larger height and a larger width than the outer ribs.

6. The blade as claimed in claim 1, wherein first impingement-cooling holes are provided in connection with said internal cooling passages for directing cooling fluid into the internal cooling passages in the form of impingement jets.

7. The blade as claimed in claim 1, wherein the first film-cooling holes are positioned for directing cooling fluid in the direction of the hot-gas flow before discharge from the first film-cooling holes.

8. The blade as claimed in claim 1, wherein an additional cooling passage is provided in a nose of the blade, and second impingement-cooling holes are provided in connection with said additional cooling passage for directing cooling fluid into the additional cooling passage.

9. The blade as claimed in claim 8, wherein second film-cooling holes lead from the additional cooling passage to the blade surface, said second impingement-cooling holes being arranged alternately with said second film-cooling holes; and second ribs or rib segments being arranged between the second impingement-cooling holes and the second film-cooling holes for increasing the heat-transfer area and for separating zones of the additional cooling passage associated with the second impingement-cooling holes and zones associated with the second film-cooling holes.

10. The blade as claimed in claim 1, wherein the internal cooling passages run in an axial direction of the blade, and the film-cooling holes each branch off from an associated internal cooling passage at an angle in the radial direction of the blade.

11. The blade as claimed in claim 1, wherein the internal cooling passages run in an axial direction of the blade, with ends of the internal cooling passages being connected by radial passages, and the film-cooling holes being arranged between the internal cooling passages and starting from the radial passages.

12. The blade as claimed in claim 1, wherein the internal cooling passages run at an angle in the radial direction, and the film-cooling holes each branch off from an associated internal cooling passage in the axial direction.

13. The blade as claimed in claim 1, wherein the internal cooling passages run at a first angle in the radial direction, and the film-cooling holes each branch off from an associated internal cooling passage at a second angle in the radial direction.

14. The blade as claimed in claim 1, wherein a plurality of film-cooling holes branch off from an internal cooling passage distributed over the passage length.

15. The blade as claimed in claim 1, wherein deflections are provided in the internal cooling passages for producing the counterflow.

16. The blade as claimed in claim 1, wherein the internal cooling passages are adapted to receive a cooling fluid at different axial positions for producing the counterflow.

* * * * *